US005558152A

United States Patent [19]

Anderson

[11] Patent Number: 5,558,152

[45] Date of Patent: Sep. 24, 1996

[54] SELF-CLEANING CORE PRINT

[75] Inventor: Stuart W. Anderson, Bedford, Ind.

[73] Assignee: General Motors Corporation, Detroit, Mich.

[21] Appl. No.: 419,564

[22] Filed: Apr. 10, 1995

[51] Int. Cl.[6] ..... B22C 21/14

[52] U.S. Cl. ..... 164/340; 164/369; 164/397

[58] Field of Search ..... 164/369, 397, 164/137, 340, 28, 228, 398

[56] References Cited

U.S. PATENT DOCUMENTS 818,413 3/1904 Caldwell ..... 164/397

2,239,381 3/1939 Colwell .

5,465,778 11/1995 Clark et al. .

*Primary Examiner*—Jack W. Lavinder

*Assistant Examiner*—Randolph S. Herrick

*Attorney, Agent, or Firm*—Lawrence B. Plant

[57] ABSTRACT

A pressure casting system including a core having self-cleaning core prints. The core prints are spaced from the bottom wall of the pockets with which they mate, and include channels for admitting molten metal into the print-pocket space so provided.

6 Claims, 2 Drawing Sheets

SELF-CLEANING CORE PRINT

This invention relates to a pressure casting system including expendable cores having self-cleaning core prints for positioning the core in the die cavity.

BACKGROUND OF THE INVENTION

It is well known to use expendable cores (e.g., sand, salt, etc.) to define internal features of metal castings. For example, resin-bonded sand cores are used to define the cooling jacket in internal combustion engine blocks. Molten metal is cast about the core, and, following solidification, the core is removed by mechanical, thermal, or chemical means. It is likewise well known to position and hold the cores in the die cavity by means of so-called "core print(s)" which are projections extending from the core and which mate with conforming pockets in the wall(s) of the die defining the molding cavity.

Many cores, and particularly sand cores, are quite friable particularly after having been heated to the casting temperature of the metal. As a result, when the die is opened and the casting removed, pieces of the core print can break off and remain in the pockets which interferes with proper positioning of the next core print.

The present invention overcomes the aforesaid difficulties by providing a self-cleaning core print for insuring that all of the core print material is removed from the die pocket therefor.

BRIEF DESCRIPTION OF THE INVENTION

The present invention comprehends a pressure casting system (e.g., die casting, squeeze casting, etc.) comprising a die having an internal surface that defines a casting cavity. The die includes at least one (preferably more) core-print pocket(s) in the surface of the die, which pocket(s) is itself defined by side and bottom walls. An expendable core (e.g., sand) is positioned in the cavity to define an internal feature of the casting, and includes at least one core print extending from the core into nesting relation with the pocket which is shaped to conform to the core print so as to hold the core in position in the casting cavity. The core print itself is defined by an end surface at the distal end thereof and an external surface surrounding the core print and engaging the side wall of the pocket at an interface therebetween. In accordance with the present invention, the core prints are rendered self-cleaning by shaping the core print such that (1) it's end surface will be spaced from the bottom wall of the pocket so as to provide a gap therebetween when the core print is nested in the pocket, and so as (2) to provide at least one flow channel at the interface between the external surface of the core print and the side wall of the pocket to admit molten metal therethrough into the gap during casting. Upon solidification and removal of the casting from the die, the metal solidified in the gap and secured to the casting by the metal solidified in the channel(s) functions to scrape out or otherwise remove any loose or broken off core print material that might otherwise remain lodged in the pocket.

DETAILED DESCRIPTION OF PREFERRED EMBODIMENTS OF THE INVENTION

Figure 1:
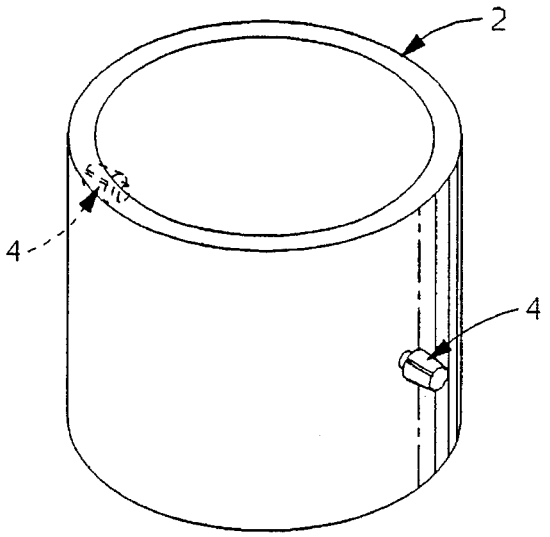
FIG. 1 is a perspective view of an expendable core.
Figure 2:
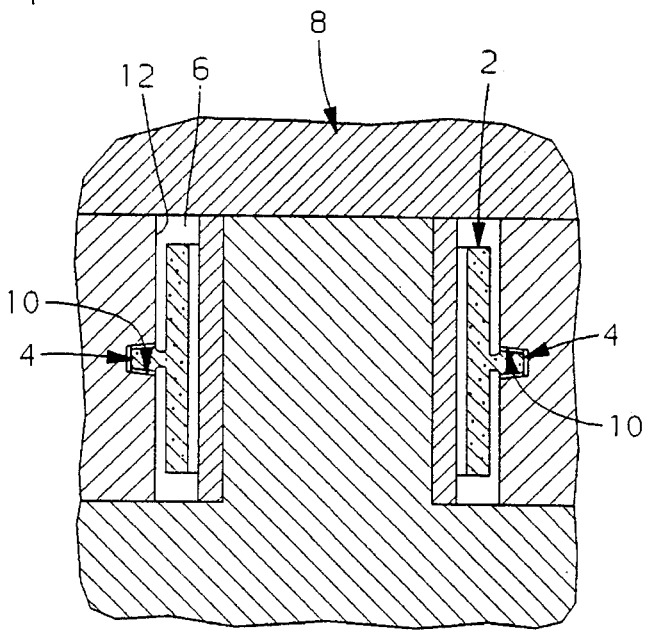
FIG. 2 is a partial, side-sectional view illustrating the core of FIG. 1 positioned in a pressure casting die.
Figure 3:
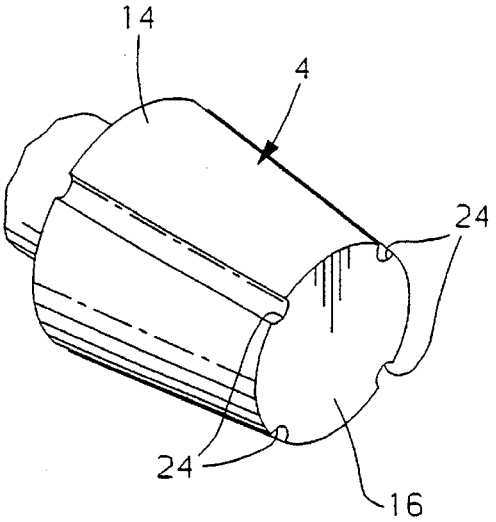
FIG. 3 is a perspective view of a core print broken away from the core of FIG. 1.
Figure 4:
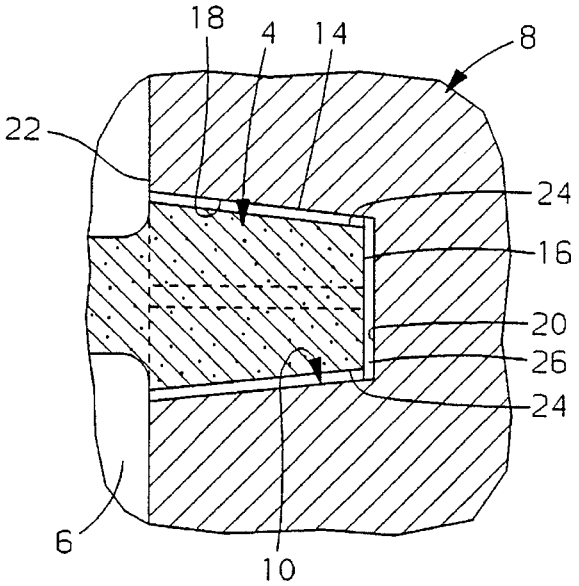
FIG. 4 is an enlarged portion of FIG. 2 taken where the core print mates with the die.

FIGS. 1 and 2 depict an expendable sand core 2 having a pair of core prints 4 for holding the core 2 in the casting cavity 6 of die 8. The core prints 4 nest snugly in conforming pockets 10 formed in the die surface 12 defining the casting cavity 6. As best shown in FIGS. 3 and 4, the core print 4 has a frusto-conical shape and is defined by an external surface 14, and end surface 16 on the distal end of the core print 4. The core print 4 nests in the pocket 10 in the die 8, which pocket is defined by side wall 18 and bottom wall 20. The core print 4 nests snugly in the pocket 10 such that the core-print defining surface 14 and the pocket-defining wall 18 meet along an interface 22 therebetween. A plurality of channels (i.e., grooves) 24 are formed in the surface 14 of the core print 4. The core print 4 is shaped/sized such that, when snugly fitted within the pocket 10, the end surface 16 is spaced from the bottom wall 20 by a small gap 26 which communicates with the casting cavity 6 via the several channels 24. When molten metal is cast into the cavity 6, a small portion thereof flows through the channels 24 into the gap 26 and solidifies as a slug therein. Upon removal of the casting from the die, the metal in the channels 24 and gap 26 help to maintain the integrity of the core print 4. If some of the core print does break off, the slug of metal scrapes it out of the pocket 10.

Figure 5:
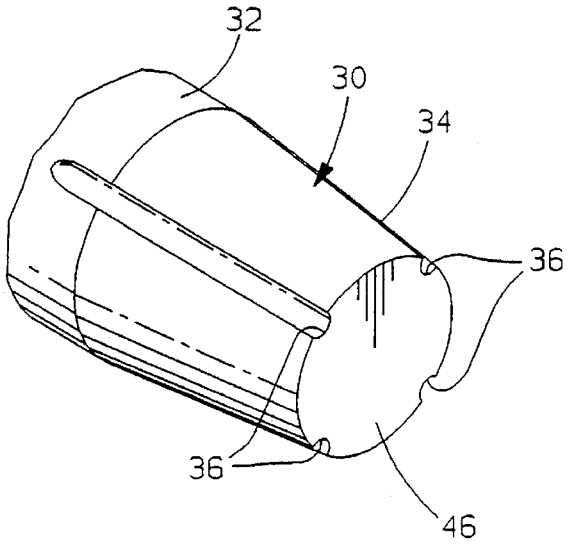
FIG. 5 is a perspective view of another embodiment of the self-cleaning core print of the present invention.
Figure 6:
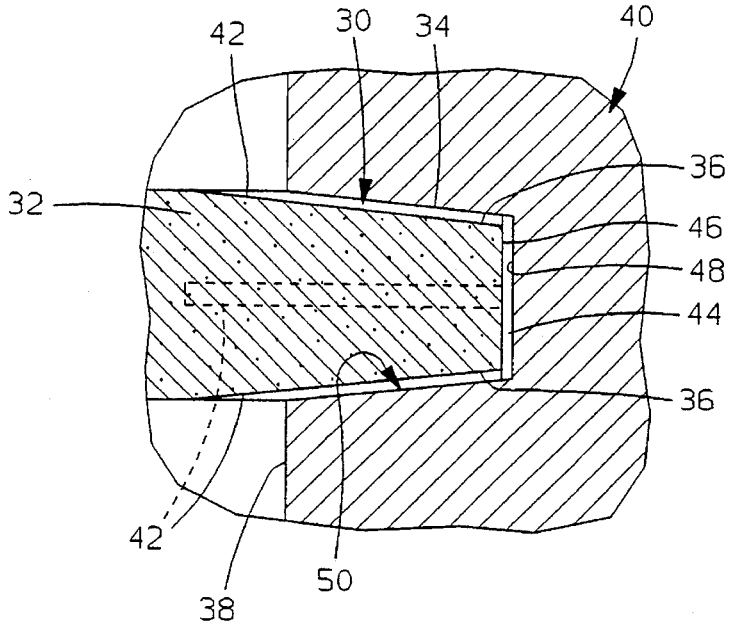
FIG. 6 is a view like FIG. 4 as applied to the core print of FIG. 5.

FIGS. 5 and 6 depict another embodiment of the present invention wherein the core print 30 comprises a cylindrical stud 32 extending from the core 2 which stud 32 has the end 34 thereof tapered in the frusto-conical shape indicated in the Figures. Grooves 36 extend somewhat passed the internal surface 38 of the die 40 as indicated at 42 for admitting the molten metal into the grooves 36 for filling the gap 44 between the end surface 46 of the core print 30 and the bottom wall 48 of the pocket 50.

Figure 7:
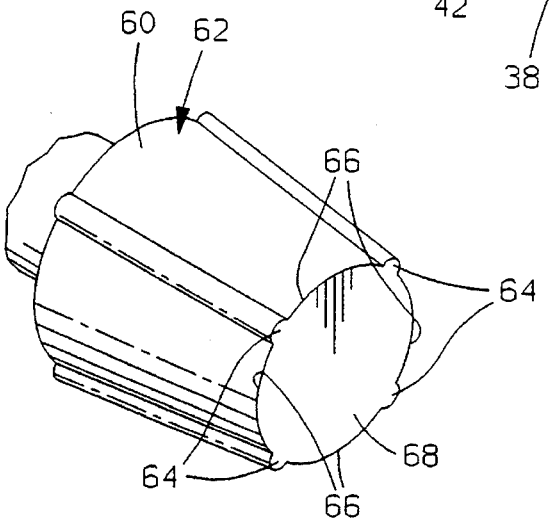
FIG. 7 is a perspective view of still another embodiment of the present invention.

FIG. 7 depicts another embodiment of the present invention which is similar to the other embodiments, but wherein the external surface 60 of the core print 62 includes a plurality of ribs 64 which engage the side walls of the pocket in the die, and together therewith define channels 66 for flow of the molten metal around the end 68 of the core print 62.

While all of the embodiments set forth above depict the channels being formed in the core print, it is to be understood that the channels may alternatively be formed in the side wall defining the pocket that receives the core print.

While the invention has been described primarily in terms of certain specific embodiments thereof it is not intended to be limited thereto but rather only to the extent set forth hereafter in the claims which follows.

What is claimed is:

1. In a pressure casting system comprising a die having an internal surface defining a cavity for forming a metal casting, at least one pocket in said die at said surface, said pocket being defined by a side wall and a bottom wall, an expendable core positioned in said cavity to define an internal feature of said casting, at least one core print extending from said core and nesting in said pocket to hold said core in position in said cavity, said core print being defined by an end surface at the distal end of said core print and an external surface surrounding said core print and engaging said side wall at an interface therebetween, the improvement comprising: said end surface being spaced from said bottom wall so as to provide a gap therebetween, and at least one flow channel extending along said interface communicating said cavity with said gap to admit molten metal into said gap during casting, whereby said molten metal solidifies in said gap and said channel and facilitates complete removal of said core print from said pocket after the die is opened and the casting removed therefrom.

2. A pressure casting system according to claim 1 wherein said channel is formed in said side wall defining said pocket.

3. A pressure casting system according to claim 1 wherein said expendable core comprises sand.

4. A pressure casting system according to claim 3 wherein said core print includes a plurality of said channels.

5. A pressure casting system according to claim 4 wherein said channels are grooves formed in said external surface.

6. A pressure casting system according to claim 4 wherein said channels are defined by ribs formed on said external surface.

* * * * *